United States Patent [19]

Reider

[11] 4,296,606

[45] Oct. 27, 1981

[54] POROUS LAMINATED MATERIAL

[75] Inventor: Samuel B. Reider, Indianapolis, Ind.

[73] Assignee: General Motors Corporation, Detroit, Mich.

[21] Appl. No.: 85,818

[22] Filed: Oct. 17, 1979

[51] Int. Cl.[3] ..... F02C 7/18

[52] U.S. Cl. ..... 60/754; 219/101

[58] Field of Search ..... 60/754; 416/219 C; 219/101-107

[56] References Cited

U.S. PATENT DOCUMENTS

| | | | |
|---|---|---|---|
| 2,999,146 | 9/1961 | Kaplan et al. | 219/106 |
| 3,584,972 | 6/1971 | Bratkovich et al. | 416/219 C |
| 4,180,972 | 1/1980 | Herman et al. | 60/754 |
| 4,213,024 | 7/1980 | Costley | 219/106 |

OTHER PUBLICATIONS

Nealy, D. A. et al., "Evaluation of Laminated Porous Wall Materials for Combustor Liner Cooling," Journal of Engin. for Power, Apr., 1980, pp. 268-276.

*Primary Examiner*—Robert E. Garrett

*Attorney, Agent, or Firm*—J. C. Evans

[57] ABSTRACT

A porous, laminated metal fabrication includes first and second porous walls, each having laminae therein with a free edge portion across at least one end thereof; each of the first and second walls including an outer lamina with a first preformed hole pattern therein, each of the first and second walls further including an inner lamina having a second preformed hole pattern therein combined to form a tortuous air flow path through the first and second walls for cooling the metal therein; and each of the lamina in the laminae including a solid metal annulus therein of uniform density for welding; the annulus being located between the hole patterns and the free edge portions to define a weldable region between the first and second walls having an axial width limited to the axial width of the solid metal annulus whereby air flow through the first and second walls will flow freely throughout the full extent of all the performed hole patterns therein so as to maintain full coolant flow from exteriorly of the porous laminated fabrication to an inner surface thereon.

3 Claims, 5 Drawing Figures

POROUS LAMINATED MATERIAL

This invention relates to porous laminated metal constructions, and more particularly to porous laminated wall materials and constructions for use in combustor liner cooling and gas turbine engine component applications.

Various proposals have been suggested for producing transpiration cooling of the internal walls and other portions of gas turbine engine components operated in high temperature environments. An example of such transpiration cooling can be found in combustor assemblies for use in gas turbine engines wherein transpiration cooling of the inner wall surface of the combustor can represent the most thermodynamically efficient approach to combustor cooling. However, in the past, laminated porous metal fabrications for forming the liner walls of such combustors have had welded perforated ends of variable metal density construction. Such welds have a substantial width which blocks certain of the inlet or outlet pores into the liner of the combustor, thereby to reduce the cooling effectiveness at the laminated porous wall material and the effectiveness of transpiration cooling at the coolant outlet surface thereof.

An example of porous laminated material suitable for use with the present invention is set forth in U.S. Pat. No. 3,584,972, issued June 15, 1971, to Bratkovich et al for LAMINATED POROUS METAL.

Furthermore, a full discussion of an evaluation of laminated porous wall materials is set forth in ASME Paper No. 79-GT-100 entitled "Evaluation of a Laminated Porous Wall Material For Combustor Liner Cooling" by D. A. Nealey and S. B. Reider published March, 1979. The paper discusses reduction of liner wall cooling flows at peripheral details such as welds, mechanical attachments, scoops and other typical component parts of gas turbine engine combustor assemblies.

Accordingly, an object of the present invention is to provide an improved porous laminated metal fabrication including multiple walls, each having free edge portions thereon and each including lamina diffusion bonded to one another and with each lamina including preformed hole patterns across a portion thereof; each of the lamina further including a solid metal weldable portion of uniform metal density thereon interposed between the hole patterns and the free edges of the walls for defining a region for a weld connection having an axial width that is limited to the axial width of each of the solid metal weldable portions, whereby the two walls can be welded to one another without flow of weld material into the preformed hole patterns of the lamina, thereby to maintain full coolant flow from exteriorly of the porous laminated metal fabrication through the hole patterns therein during gas turbine operation.

Another object of the present invention is to provide an improved porous laminated metal combustor assembly for use in gas turbine engine applications to produce transpiration cooling at the inner surface of the metal combustor in surrounding relationship to a combustion chamber therein and wherein the combustor assembly comprises first and second walls, each having lamina with a free edge portion thereon and each of the lamina having preformed hole patterns therein separated from the free edge by a solid metal weldable ring of uniform metal density in the walls to form a weld region between the first and second walls and wherein a weld in the weld region has an axial width limited to the axial width of each of the solid metal rings without flow of weld material into any of the preformed hole patterns of the lamina, thereby to maintain unrestricted air flow through the first and second walls and through the full extent of all the preformed holes in the lamina, whereby full coolant flow is maintained from exteriorly of the combustor assembly to the inside surface thereof during gas turbine engine operation.

For a better understanding of the present invention, together with additional objects, advantages and features thereof, reference is made to the following description and accompanying drawings in which.

Figure 1:
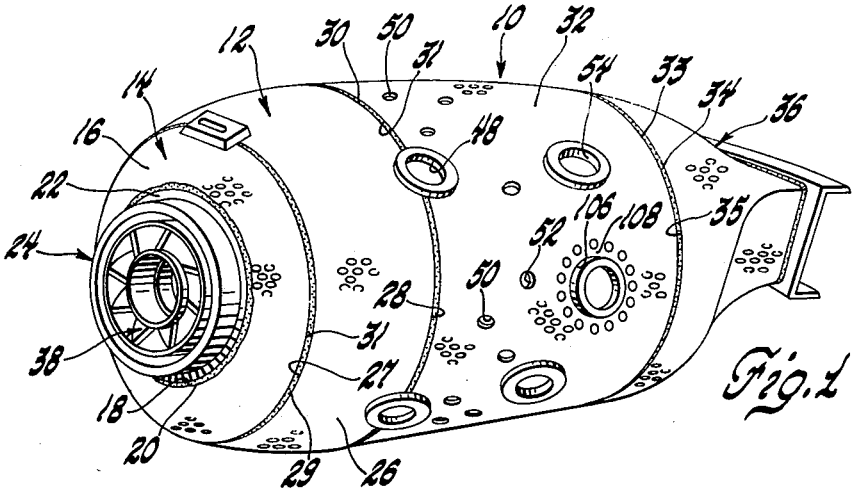
FIG. 1 is a perspective of a combustor assembly including the porous laminated fabrication of the present invention.
Figure 2:
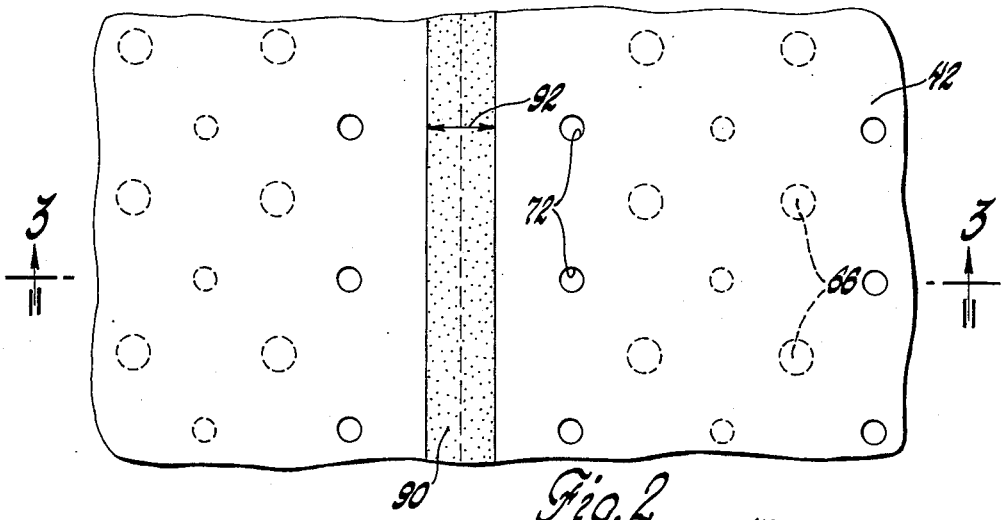
FIG. 2 is a fragmentary elevational view of a portion of the outer surface of the combustor in FIG. 1.

Referring now to the drawings, FIG. 1 shows a combustor assembly 10 including a porous laminated liner fabrication 12 constructed in accordance with the present invention.

Liner 12 has a dome 14 with a first contoured ring 16 of porous laminated material that includes a radially inwardly located edge portion 18 thereon secured by an annular weld 20 to a radially outwardly directed flange 22 of a support ring 24. A radially outwardly divergent contoured ring portion 26 of dome 14 also is made of porous laminated material. The contoured ring portion 26 has its upstream edge 27 connected by an annular weld 29 to downstream edge 31 of ring 16. Downstream edge 28 of ring portion 26 is connected by an annular weld 30 to upstream edge 31 of a porous laminated sleeve 32 which has its downstream edge 33 connected by means of an annular weld 34 to upstream edge 35 of a flow transition member 36 of porous laminated material.

Ring 24 forms a housing for an air blast fuel nozzle assembly 38 that directs air and fuel into a combustion chamber 40 within the combustor assembly 10.

In accordance with the present invention, the liner 12 of the combustor assembly 10 is defined by the dome 14, contoured rings 16, 26 and sleeve 32 to produce a transpiration cooled wall construction that minimizes the requirement for wall cooling air while adequately cooling the inside surface of the combustor assembly 10 exposed to the flame front within the combustion chamber 40.

Each wall segment of porous laminated liner 12 as shown in FIGS. 2–5 is made up of a plurality of porous sheets or lamina 42, 44, 46. The pores have a diameter such that the liner 12 has a discharge coefficient of 0.006 per square inch of liner wall area. Air distribution into combustor assembly 10 includes 11.5% of total air flow via assembly 38. A front row of primary air holes 48 receives 14.5% of total air flow; a pair of rows of intermediate air holes 50, 52 receives 8% and 5.6%, respectively, of the total combustor air flow. Dilution air holes 54 in sleeve 32 receive 35.8% of the total combustor air flow.

The remainder of the total combustor air flow is through the liner wall pores. The aforesaid figures are representative of flow distributions in combustors using the invention. Cooling of the inner surface 56 of liner 12 is in part due to transpiration cooling as produced by flow of compressed air from a duct space or inlet air plenum 58 surrounding combustor assembly 10 to a point radially inwardly of the liner 12 through a plurality of pores and grooves therein in accordance with the present invention to form an air barrier inside of the liner 12 around the combustion chamber 40. Air flow through holes 48, 50, 52, 54 penetrates into chamber 40 to a depth greater than the transpiration cooling barrier.

In fabrication of combustor assemblies such as combustor assembly 10 disclosed above, it is desirable to have a specifically configured pattern of pores and grooves in the layered material making up the laminate to improve the strength of the wall section as well as to reduce manufacturing costs thereof.

In the illustrated embodiment of the invention, a three-layer laminate includes the outer lamina 42 and an intermediate lamina 44.

The lamina 42 includes a plurality of inwardly directed pins 66 to define grooves 68 formed across the inner surface 70 thereof. Pins 66 are bonded to lamina 44 at the outer surface 71 thereof. At spaced points the outer lamina 42 has pores or holes 72 etched therein which intersect the grooves 68. The pores 72 define inlet openings from the duct 58 to direct cooling air therefrom to the grooves 68. The intermediate lamina 44 has pins 74 on its inner surface 76 to form grooves 78 thereacross. Pins 74 are bonded to the outer surface 80 of lamina 46. Holes 82 in the lamina 44 intersect grooves 68 and 78 to direct coolant through lamina 44. The inner lamina 46 also has holes 84 therein that intersect inner surface 86 of the inner lamina 46 which bounds combustion chamber 40. Cooling air thence flows through a plurality of outlet holes 84 in the inner lamina 46 for flow of cooling air from the porous laminated liner 12.

While three lamina material is shown the invention to be described is applicable to two lamina material. If the overall thickness of the laminated material remains the same, the two lamina construction is arranged so that each of the individual layers will have a slightly greater thickness than the thickness of the three lamina configuration. As a result, when pores are photoetched or otherwise machined in the two lamina construction, they can have a slightly greater diameter than in the three lamina construction while maintaining desired strength characteristics.

To be more specific, regarding the scale of the parts to be bonded together, in the embodiments of FIGS. 1 through 5, the individual sheets have a thickness in the order of 0.020 inches and the hole spacing of the pores or holes is in the order of 0.136 inches. The pores and the grooves having the pattern set forth above are preferably obtained by photoetching processes wherein the individual layers of the sheet are etched or otherwise formed and are then united into a laminate by a suitable diffusion bonding process.

Representative types of high temperature alloys which are suitable for use in forming porous material having the configuration set forth in the illustrated embodiment are set forth in the tabulation below. Such materials are resistant to extremely high temperature operation in environment such as gas turbine engines.

| Name | AMS Spec. | Cr | Co | Mo | Ti | W | Al | Fe | Ni |
|---|---|---|---|---|---|---|---|---|---|
| Hastelloy X | 5536 | 22 | 1.5 | 9.0 | — | 0.6 | — | 18.5 | Base |
| Haynes 188 | 5608 | 22 | Base | — | .07 | 14.5 | — | — | 22 |
| Inconel 601 | 5870 | 23 | — | — | — | — | 1.35 | 14.0 | Base |
| Hastelloy S | 5873 | 15.8 | — | 12.5 | .05 | — | .3 | — | Base |

In such porous laminated fabrications for use in high temperature components of gas turbine engines such as combustor assembly 10 shown in FIG. 1, heretofore, axial end edges of walls in such porous laminated walled combustors have had the pore or hole configurations therein formed up to and into the vicinity of the wall edges that are connected together; for example, such as at the connection between the contoured ring 16 and the contoured ring portion 26 and its connection to the sleeve 32 and, in turn, its connection to the transition member 36.

As a result, the ends have variable metal density and excessively wide weld areas are required to produce a strong connection joint.

Figure 3:
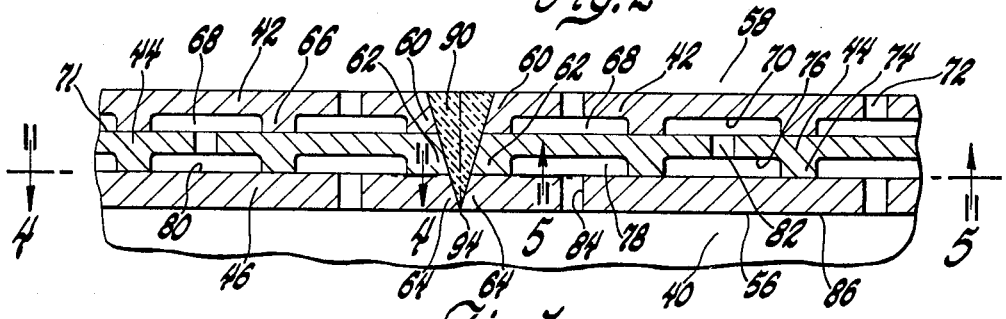
FIG. 3 is a fragmentary vertical sectional view taken along line 3—3 of FIG. 2 looking in the direction of the arrows.
Figure 4:
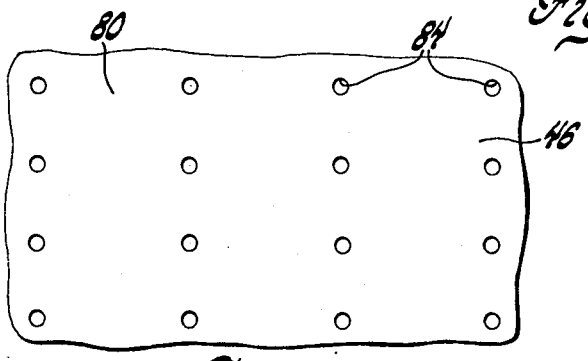
FIG. 4 is a reduced fragmentary sectional view taken along the line 4—4 of FIG. 3 looking in the direction of the arrows.
Figure 5:
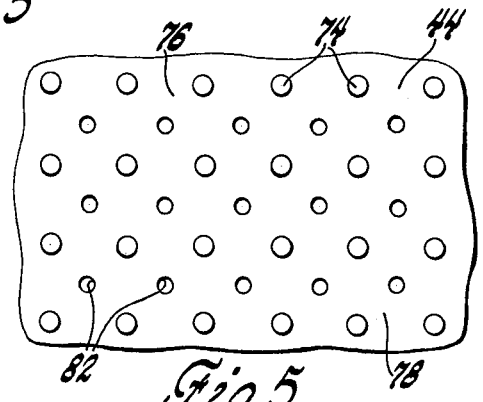
FIG. 5 is a reduced fragmentary sectional view taken along the line 5—5 of FIG. 3 looking in the direction of the arrows.

In accordance with the present invention, each of the edges to be joined has solid metal ring portions, such as those shown at 60, 62, 64 in FIG. 3. The width of the solid metal ring at the edge assures a uniform density of material at the weld joint and in one working embodiment it has been found that the width of the solid ring portions can be in the order of one-half of the overall thickness of the diffusion bonded lamina 42, 44 and 46, as shown in FIG. 3. The material is then welded by electron beam or laser beam welding to form an annular weld region of triangular cross sectional area 90 which is formed continuously around each of the adjoined parts at welds 29, 30, 34, as shown in FIG. 1. The area 90 throughout the annulus thereof has an outer width 92 which, in the illustrated arrangement, is greatest at the outer surface of the porous laminated wall or liner and a divergent configuration to an apex 94 at the inner surface 56 of the wall, as shown in FIG. 3. Such an arrangement minimizes heat affected areas in the arrangement.

The use of solid edges, without any air flow holes or pores therein, also can be utilized in the vicinity of holes 48, 50, 52 and 54. Hence, as shown in FIG. 1, around each of the holes and as shown exaggerated at dilution air hole 54, the edge region 106 therearound is an entry hole that has a solid edge 108 without perforations or holes therein. It has been found that the provision of a solid metal ring without perforations or pores therein eliminates stress concentration and localized heating effects at the vicinities of the primary, secondary and dilution air holes of the combustor assembly.

Accordingly, the resultant connections between the various portions of the combustor 10 having porous laminated wall construction therein, are arranged so that weld joint width will be minimized and will be maintained within the confines of a metal section having uniform density through-out both the width and the annular extent of the joints formed in the combustor assembly 10 for an improved weld joint that has reduced width while forming a strong weld in the combustor. Accordingly, the joints formed between the parts, by practicing the present invention, have adequate air flow through the hole patterns and thereby avoid overheating of joint areas in the combustor assembly.

Likewise, the provision of solid metal marginal extents around each of the combustion-air and dilution-air holes in the construction, such as at the primary holes 48 and the dilution holes 54, as well as the secondary holes 50, 52 results in a structure that avoids high stress regions encountered because of temperature differences between the outer and the inner surfaces of such porous laminated materials.

While the invention has been described in terms of specific embodiments thereof, other forms may readily be adapted by those skilled in the art. Thus, the invention is limited only by the following claims.

The embodiments of the invention in which an exclusive property or privilege is claimed are defined as follows:

1. A porous laminated metal fabrication for a high temperature gas turbine engine component comprising first and second walls each having plural lamina with a free edge portion thereon, each of said first and second walls having a first lamina with a surface having a first preformed hole pattern therein, each of said first and second walls including a second lamina bonded to said first lamina, said second lamina having a surface with a second preformed hole pattern therein to form a tortuous air flow path through said first and second walls for cooling the metal therein, said wall holes directing coolant flow to form an air barrier on one of the lamina surfaces, each of said lamina having a solid metal section formed therein between said holes and said edge portions to define a weldable region of uniform metal density throughout a predetermined width between said first and second walls, a weld in said weldable region connecting said edge portions and having a width limited to the width of said region of uniform metal density whereby air flow through the first and second walls is free to flow through the full extent of all the preformed hole patterns in said lamina thereby to maintain full coolant flow therethrough during gas turbine engine operation.

2. A porous laminated metal combustor comprising first and second walls each having plural lamina with a free edge portion thereon, each of said first and second walls having an outer lamina with a first preformed hole pattern therein, each of said first and second walls including an inner lamina having a plurality of preformed holes therein to form a tortuous air flow path through said first and second walls for cooling the metal therein, said inner wall holes directing coolant flow into a combustion chamber to form an air barrier on the inside surface of the combustor in surrounding relationship to the combustion chamber therein, each of said lamina having a solid metal ring formed therein between said holes and said edge portions to define a weldable region of uniform metal density throughout a predetermined width between said first and second walls, a weld in said weldable region having a width limited to the width of said region of uniform metal density whereby air flow through the first and second walls is free to flow through the full extent of all the preformed hole patterns in said laminae thereby to maintain full coolant flow from exteriorly of the combustor assembly to the inside surface thereof during gas turbine engine operation.

3. A porous laminated metal combustor comprising a wall having plural lamina, said wall having a first lamina with a first preformed hole pattern and a second lamina having a second preformed hole pattern therein to form a tortuous air flow path through said lamina for cooling the metal therein, said wall having another hole therein, said second lamina holes directing coolant flow into a combustion chamber to form an air barrier on the inside surface of the combustor in surrounding relationship to the combustion chamber therein, said other hole directing air to penetrate into the chamber to a greater depth than that of said air barrier, each of said lamina having a solid metal ring formed therein around said other hole to define an annular region of uniform metal density for diffusion bonding between said first and second lamina, said annular region having a width limited to that required to control thermally induced stress at the edge of said other hole without restricting flow through the full extent of all the preformed holes in said lamina thereby to maintain full coolant flow from exteriorly of the combustor assembly to the inside surface thereof during gas turbine engine operation.

* * * * *